US005414607A

United States Patent [19]

Harris et al.

[11] Patent Number: 5,414,607

[45] Date of Patent: May 9, 1995

[54] OUTDOOR LANDSCAPE LIGHTING FIXTURE

[75] Inventors: William F. Harris; Michael R. Helms, both of Charlotte, N.C.

[73] Assignee: W.F. Harris Lighting, Inc., Monroe, N.C.

[21] Appl. No.: 93,457

[22] Filed: Jul. 19, 1993

Related U.S. Application Data

[63] Continuation-in-part of Ser. No. 951,140, Sep. 25, 1992, abandoned.

[51] Int. Cl.[6] ..... F21V 21/00; F21V 23/00

[52] U.S. Cl. ..... 362/362; 362/431

[58] Field of Search ..... 362/153.1, 431, 363, 362/253, 362

[56] References Cited

U.S. PATENT DOCUMENTS

| | | | |
|---|---|---|---|
| 1,777,509 | 10/1930 | Underwood | 362/431 |
| 3,104,064 | 9/1963 | Bellek | 362/267 |
| 3,364,635 | 1/1963 | Guggemos | 362/431 |
| 4,521,836 | 6/1985 | Puttermanns et al. | 362/431 |
| 4,523,263 | 6/1985 | Poyer | 362/431 |
| 4,564,890 | 1/1986 | Poyer | 362/431 |
| 4,774,648 | 9/1988 | Kakuk et al. | 362/431 |
| 4,787,018 | 11/1988 | Poyer | 362/431 |
| 4,858,877 | 8/1989 | Carter . | |
| 4,878,160 | 10/1989 | Reneau et al. | 362/431 |
| 4,966,636 | 2/1991 | Lovett | 362/431 |

OTHER PUBLICATIONS

HADCO catalog page showing Rocket Perma-Post Three photograps of fixture depicted in HADCO catalog page.

*Primary Examiner*—Richard R. Cole

*Attorney, Agent, or Firm*—Shefte, Pinckney & Sawyer

[57] ABSTRACT

An outdoor ground-supported light fixture having a non-conductive hollow staff and having a lower end for disposition in the ground and an upper end where electrical conductor elements are received by the lower end into the staff and where the electrical conductor elements exit the staff from the upper end is disclosed. The light fixture also includes a shade unit having a non-conductive wiring compartment integral therewith. The unit has a top end and a bottom end with the wiring compartment located at the bottom end of the unit. The bottom end of the unit is for connection with the upper end of the staff. The compartment has a base with an aperture therein for receiving the electrical conductor elements from the upper end of the staff through the aperture. The compartment has a lamp receiving device devised for connecting a lamp to the electrical conductor elements.

4 Claims, 4 Drawing Sheets

OUTDOOR LANDSCAPE LIGHTING FIXTURE

This is a continuation-in-part of U.S. application Ser. No. 07/951,140, filed on Sep. 25, 1992, now abandoned.

FIELD OF THE INVENTION

This invention relates generally to lighting fixtures and, more particularly, to outdoor lighting fixtures.

BACKGROUND OF THE INVENTION

Various types of outdoor lighting fixtures are known. Such fixtures typically serve both utilitarian and decorative purposes in that they aid in lighting outdoor lawns, decks, patios, parking lots, driveways, and other areas, as well as being of an attractive design to complement such areas.

One aspect of existing 120 V outdoor light fixtures detracting from the decorative nature of these fixtures is the need for an electrical connector device separate from the shade unit bearing the light bulb of the fixture to connect the supply wires from the power source to the lamp. The electrical connector device typically known as a junction box is typically housed in a box-like structure. These additional boxes are bulky and detract from the appearance of the outdoor light fixture. A representative form of such a conventional outdoor light fixture is shown in FIG. 1. Some non-120 V outdoor light fixtures do not require junction boxes such as the low voltage fixture described in U.S. Pat. No. 4,996,636 to Lovett.

Some present outdoor light fixture manufacturers attempt to avoid the unsightliness of the separate connector box in various ways. For example, in U.S. Pat. No. 4,858,877 to Carter, a plastic light standard has a length of plastic pipe with a cap at one end and a slanted cut-off portion at the opposite end. The cap includes an outside threaded nipple or an inside threaded hub for securing a light fixture to the pipe. The slanted cut-off end of the pipe allows the pipe standard to receive the ends of underground pipe at various depths in the ground. While the arrangement disclosed in the '877 patent presents a somewhat less bulky landscape fixture than the fixture shown in FIG. 1, the separate standard still detracts from the overall appearance of the landscape lighting fixture as can be seen in FIG. 1 of the '877 patent.

Other fixtures, known as bollard-type fixtures differ from typical 120 V landscape fixtures in that they are mounted on a wide diameter post (compare FIG. 1 of this application with U.S. Pat. No. 4,787,018). These wide diameter posts can accommodate supply wire connections.

Thus, a 120 V landscape lighting fixture having an area for connection of electrical circuits which does not detract from the overall appearance of the lighting fixture is needed.

SUMMARY OF THE INVENTION

It is therefore an object of the present invention to provide for a landscape lighting fixture whose electrical connections are made in such a manner so as not to detract from the overall appearance of the fixture.

This and other objects of the present invention are accomplished with an outdoor ground-supported light fixture having a non-conductive hollow staff having a lower end for disposition in the ground and an upper end for disposition above ground level for receiving below ground electrical conductor elements from the power source, known as supply wires, through the lower end into the staff and for exiting of the electrical conductor elements from the upper end of the staff. The light fixture also includes an illumination unit having a wiring compartment and at least one translucent lens as an integral unit. The wiring compartment has a base mountable to the upper end of the staff with an aperture in the base for receiving the supply wire electrical conductor elements from the upper end of the staff through the aperture and the wiring compartment has a lamp receiving device devised for connecting a lamp to the supply wire electrical conductor elements. The lens is affixed to the wiring compartment to enclose the lamp.

DESCRIPTION OF THE PREFERRED EMBODIMENT

Figure 1:
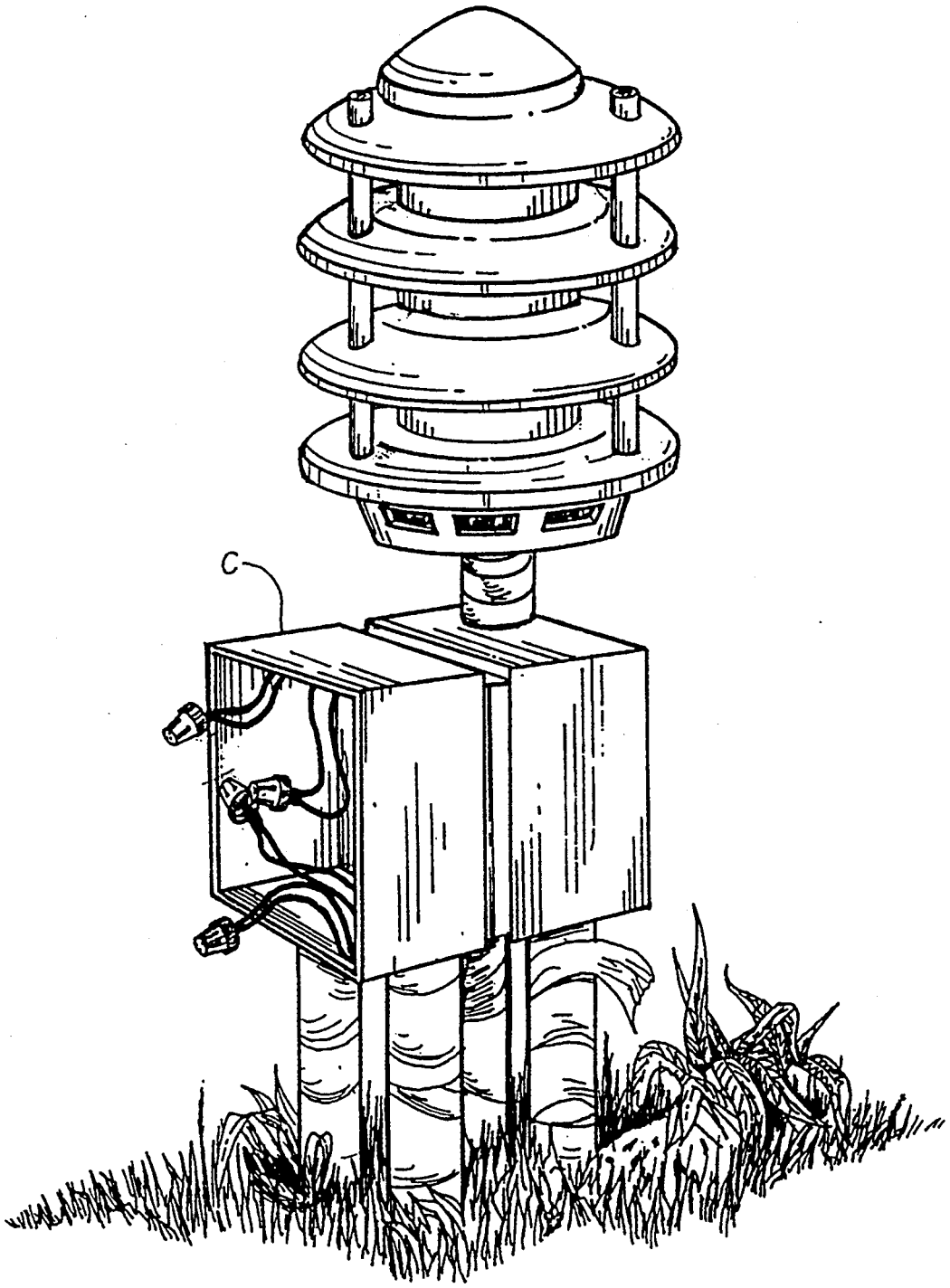
Fig. 1 (PRIOR ART)
FIG. 1 is a perspective view of a prior art landscape lighting fixture.

A prior art device is shown in FIG. 1 exhibiting a bulky separate wiring compartment C detracting from the appearance of the fixture.

Figure 2:
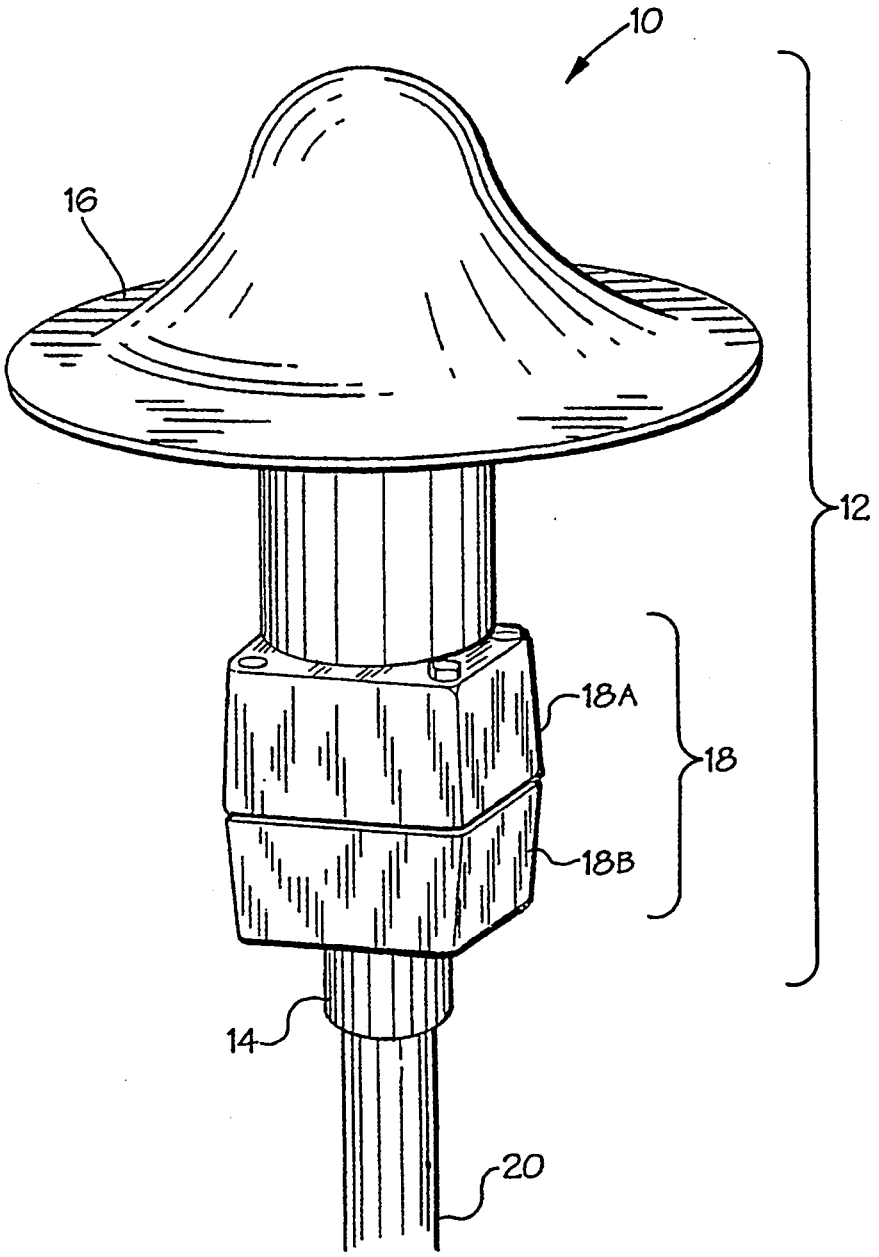
FIG. 2 is a perspective view of a landscape lighting fixture according to a preferred embodiment of the present invention.

Referring now to FIG. 2, one embodiment of a landscape lighting fixture 10 of the present invention is shown. The fixture 10 has an illumination unit 12. The illumination unit 12 comprises a lighting portion 16 as well as an integral wiring compartment 18 and a base 14. The wiring compartment is preferably a parallelopiped housing having upper 18A and lower 18B mating housing halves. The halves 18A and 18B are hollow to define an interior wiring compartment. The illumination unit is connected to a non-conductive hollow staff 20 at the hub 14.

Figure 3:
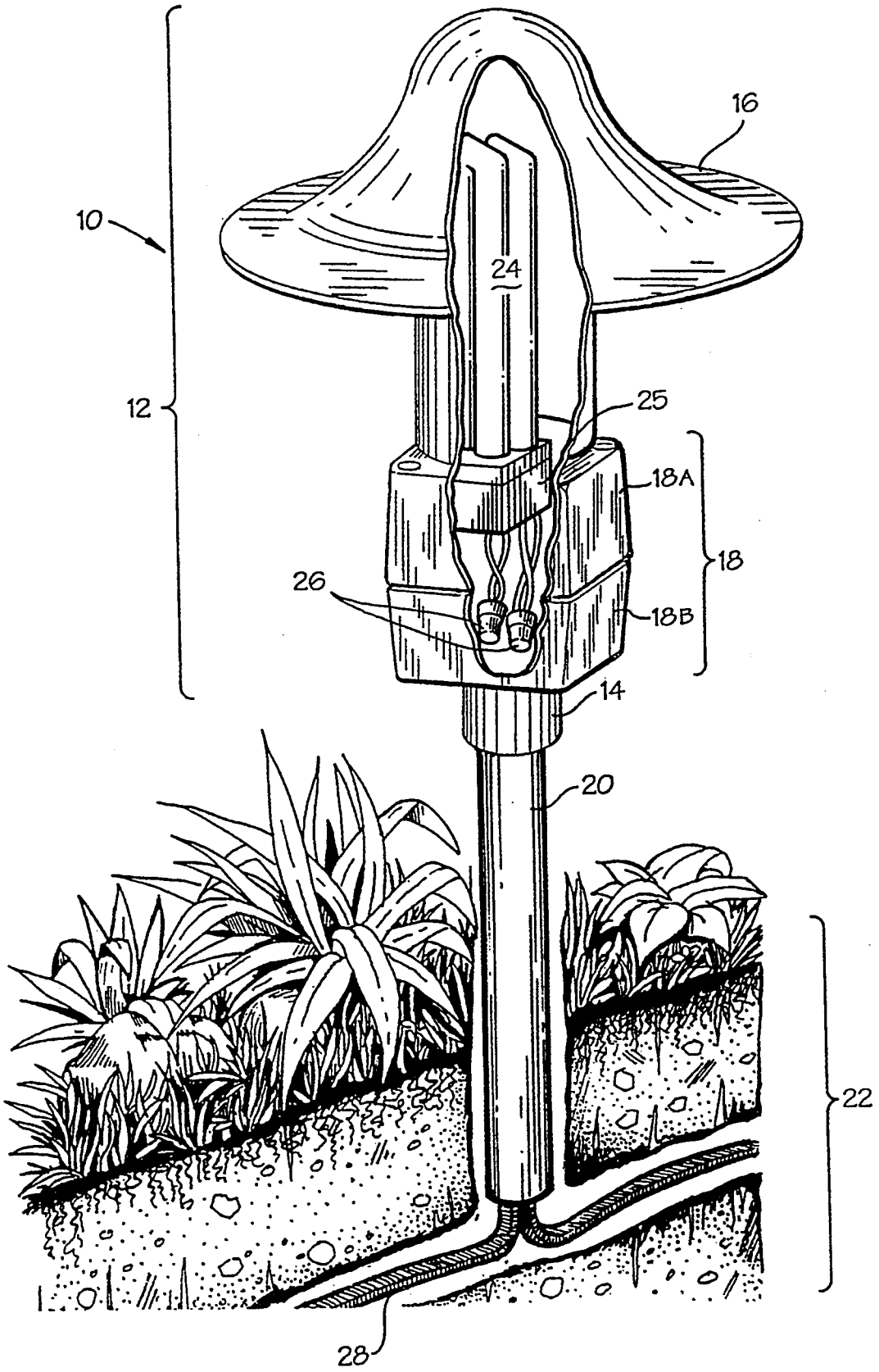
FIG. 3 is a partially sectioned perspective view of the landscape lighting fixture of the present invention shown in FIG. 3.

Referring now to FIG. 3, the landscape lighting fixture 10 is shown in a partially sectioned view disposed in the ground 22 for use. Inside the illumination unit 12, lamp 24 is connected to electrical conductor elements 28 by a lamp receiving device 25 bearing electrical contacts 26 which connect the lamp 24 to the supply wire electrical conductor elements 28. The staff or standard 20 is hollow to guide electrical conductor elements 28 from the ground 22 to electrical contacts 26. Electrical conductor elements 28 are typically insulated wire leads from a suitable source of AC electrical power.

Figure 4:
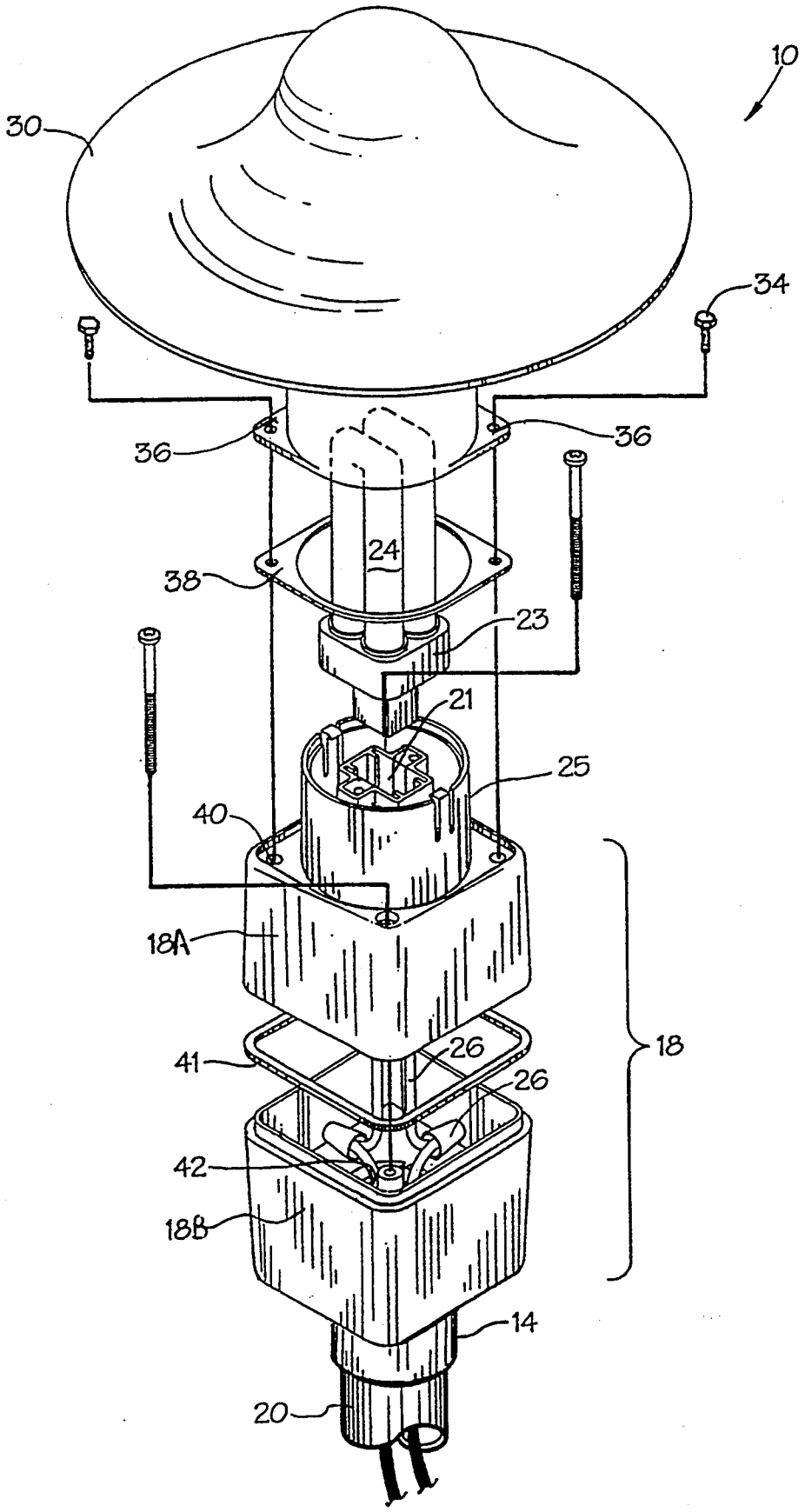
FIG. 4 is an exploded view of a landscape lighting fixture of the present invention.

Referring now to FIG. 4, an exploded view of one embodiment of a landscape lighting fixture 10 of the present invention is shown. The shade 30 of the illumination unit 12 is attached to the upper half 18A of wiring compartment 18 via screws 34 of the illumiantion unit 12 threaded through apertures 36 located on diametrically opposed mounting flanges 17 of the shade 30 and a gasket 38 to apertures 40 in the upper half 18A of wiring compartment 18. The shade 30 is preferably bell shaped and opaque. The upper half 18A and the lower half 18B of the wiring compartment 18 are designed so as to fit snugly together and may have a gasket 41 disposed therebetween to aid in securing the upper and lower halves 18A,18B together, as well as providing added protection from moisture.

The interior of the upper half 18A and lower half 18B is structured so as to fit electrical contacts 26 therein. The electrical contacts 26 have insulated electrical wire leads 26A which connect to another set of electrical contacts (not shown) within the socket 21. The lower half 18B contains an aperture 44 through which the electrical conductor elements 28 rising through hollow staff 20 can access the electrical contacts 28 for electrical connection.

The upper half 18A of the wiring compartment 18 contains a hub 25 acting as a lamp receiving device which is formed so as to receive the portion of the lamp 24 necessary for electrical contact in the socket 24 positioned within the hub 25. The socket 24 receives the base 23 of lamp 24 for electrical connection of the lamp.

In summary, an outdoor lighting fixture having a wiring compartment integral to the illumination unit of the lighting fixture is disclosed which does not detract from the overall appearance of the outdoor lighting fixture.

It will be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An outdoor ground-supported light fixture of the type adapted to operate on a 120 volt electrical power supply, the fixture being characterized by integral means for containing an electrical connection between respective electrical conductor wires from a source of 120 volt electrical power and a lamp without the need for a separate junction box, comprising:

(a) a nonconductive hollow staff having a lower end for disposition in the ground and an upper end for disposition above ground level;

(b) first electrical conductor wires from a 120 volt power source extending through said lower end into said staff and exiting from said upper end of said staff;

(c) an integral illumination unit having a wiring compartment formed unitarily with a lamp enclosure, said wiring compartment having a mating base and a cap cooperatively assembled with one another to define therebetween an interior make-up wiring enclosure, the base being mounted to said upper end of said staff with an aperture in said base receiving said first electrical conductor wires from said upper end of said staff through said aperture and the gap comprising a lamp receiving means supporting a lamp, said lamp receiving means having second electrical conductor wires extending therefrom into said make-up wiring enclosure, said lamp enclosure being integrally affixed directly to said cap about said lamp; and (d) respective ends of said first electrical conductor wires and said second electrical conductor wires being electrically joined with one another within said make-up wiring enclosure of said wiring compartment for connecting said lamp to said power source.

2. A light fixture according to claim 1 wherein said wiring compartment is formed of a non-conductive material.

3. A light fixture according to claim 1 wherein said illumination unit further comprises a shade disposed to deflect light transmitted from said lamp.

4. A light fixture according to claim 3 wherein said shade is affixed to said lens.

* * * * *